United States Patent [19]

Rüdenauer et al.

[11] Patent Number: 4,679,503

[45] Date of Patent: Jul. 14, 1987

[54] DETONATOR SECURING DEVICE

[75] Inventors: Werner Rüdenauer, Roth; Wilhelm Fürst, Buchberg; Norbert Liebl, Ruckersdorf, all of Fed. Rep. of Germany

[73] Assignee: Diehl GmbH & Co., Nuremberg, Fed. Rep. of Germany

[21] Appl. No.: 730,333

[22] Filed: May 3, 1985

[30] Foreign Application Priority Data

May 19, 1984 [DE] Fed. Rep. of Germany ..... 3418759

[51] Int. Cl.[4] ..... F42C 15/40; F42C 15/34

[52] U.S. Cl. ..... 102/208; 102/225; 102/254

[58] Field of Search ..... 102/208, 223, 225, 226, 102/229, 249, 251, 154

[56] References Cited

U.S. PATENT DOCUMENTS

| | | | |
|---|---|---|---|
| 3,677,186 | 7/1972 | Munach | 102/225 |
| 3,757,695 | 9/1973 | Fisher | 102/208 X |
| 3,861,312 | 1/1975 | Held et al. | 102/229 X |
| 3,961,577 | 6/1976 | O'Steen | 102/208 |
| 4,027,593 | 6/1977 | Campagnuolo et al. | 102/208 |
| 4,031,827 | 6/1977 | Collier | 102/208 |

*Primary Examiner*—David H. Brown

*Attorney, Agent, or Firm*—Scully, Scott, Murphy & Presser

[57] ABSTRACT

A detonator securing device for the combat charge of a projectile, including a detonator locking slide, and an impeller-generator movable along a slider guide transverse of the longitudinal axis of a projectile to a position outwardly of the wall thereof, the electrical energy of which generator serves for the release of a securing latch for the detonator locking slide.

7 Claims, 3 Drawing Figures

DETONATOR SECURING DEVICE

BACKGROUND OF THE INVENTION

1. Field of the Invention

The present invention relates to a detonator securing device for the combat charge of a projectile, including a detonator locking slide, and an impeller-generator movable along a slider guide transverse of the longitudinal axis of a projectile so as to be extendable into a position outwardly of the wall thereof, the electrical energy of which generator serves for the release of a securing latch for the detonator locking slide.

2. Discussion of the Prior Art

A detonator securing device of that type is already known from the disclosure of U.S. Pat. No. 3,861,312. However, the device is subject to essential functional disadvantages, inasmuch a mechanical latch for a displaceable impeller-generator must itself first act as a securing criterium. In addition thereto, particularly susceptible to malfunctions appears to be the therein provided second unlatching procedure in the form of an explosive pressure load on the impeller-generator; in order to irreversible deform a latching element, in that the impeller-generator is slid from its first position still further outwardly of the projectile. However, this sequence cannot always be readily kinetically predetermined, inasmuch as the explosive pressure load on the carriage which displaces the impeller-generator can lead to operational malfunctions in the generator, and the additional displacement of the impeller-generator laterally out of the projectile, leads to undesirable influences on the aerodynamics of the projectile and on the oncoming flow or velocity head conditions of the generator. Should the generator operate over the entire flying period, then it is more advantageous to permit it to remain in one position.

SUMMARY OF THE INVENTION

Accordingly, it is in recognition of these conditions that the present invention has as its object the provision of an improved detonator securing or latching device of the above-mentioned constructive type, which can be realized at a relatively small constructional volume so as to be operational with regard to mutually clearly definable unlatching criteria, whereby operational malfunctions of the impeller-generator (during the course of the unlatching procedure) as well as of the projectile, particularly during the course of its critical initial or stabilizing flight phase, are avoided as much as possible; while there should be fulfilled the criteria of the securing or latching standards with respect to two mutually independently acting surrounding unlatching criteria and also with regard to the avoidance of prestressed spring-loaded or elastic elements on the unlatching components during the assembling and latching or securing phase.

The foregoing object is inventively achieved in that the detonator securing device of the above-mentioned constructional type has a blocking member projecting into the traveling or slider guide for the detonator slider as long as the projectile has not yet been launched, and wherein a locking pin in the sliding guide for the generator carriage is releasable through the action of a control circuit which is actuated, for instance, at the ejection or, in effect, the launching of the projectile In accordance with the foregoing, the ejection of the projectile from its carrier provides the first unlatching criterium which is dependent upon the surroundings, which leads first to the compression loading of the feed or advancing compression spring for the detonator latching slider, and concurrently leads to its unlatching. After a predetermined time interval which is dependent upon the circuitry technology, a control circuit which operates independently of the operation of the impeller-generator, delivers an electrical unlatching criterium for implementing the release of the impeller-generator for movement thereof into its operative position. The surrounding oncoming air flow, acting as a second surroundings-dependent unlatching criterium, finally unlatches the securing or locking slider, whereupon the detonator is displaced into its operative or "live" position.

Thus, for the impeller-generator there exists only a single operative position; only in this position does it extend and only for so much from the periphery of the projectile, that there is afforded its operation by means of the air flow along the projectile. Any further displacement outwardly from the projectile, or structural components which would project out of the projectile, which can lead to operational and propulsive malfunctions, is no longer necessary. A non-parallel orientation of the displacement axes of the detonator latching slider with respect to that of the carriage of the impeller-generator, allows for the utilization of constructively simple, readily monitorable alternatingly functioning latching devices between the impeller-generator carriage and the latching slider, up to a stable latching at misfirings under conditions of malfunctions in the pregiven unlatching sequence.

BRIEF DESCRIPTION OF THE DRAWINGS

Additional alternatives and modifications as well as further features of the invention can now be ascertained from the following detailed description, taken from the following details in conjunction with the accompanying drawings; in which.

DETAILED DESCRIPTION

Figure 1:
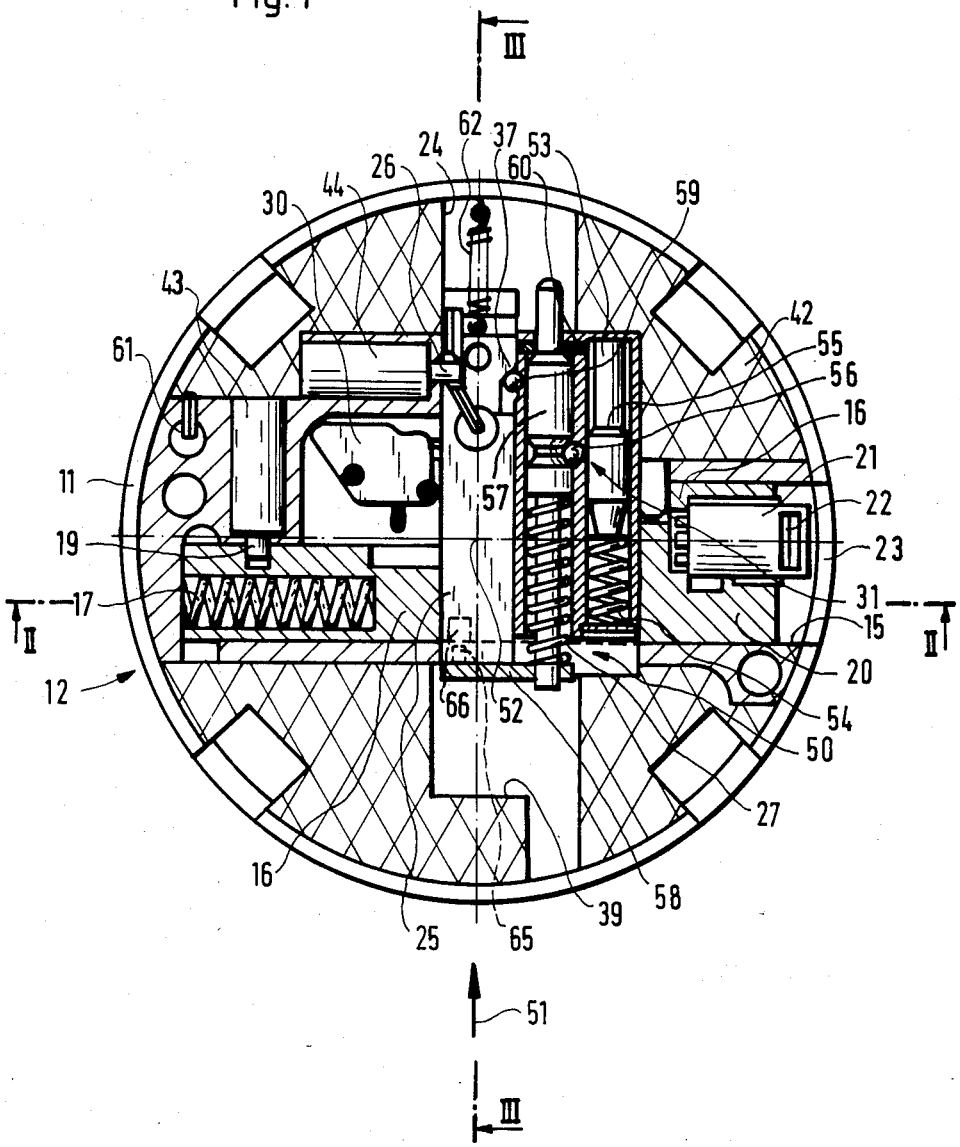
FIG. 1 illustrates a transverse sectional view of the inventively equipped detonator securing device, shown in its position wherein it is secured by a ball-shaped blocking element.
Figure 2:
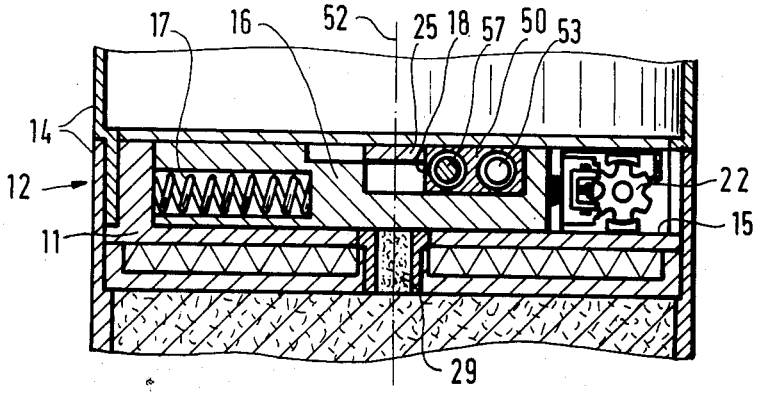
FIG. 2 illustrates a longitudinal sectional view of a fragment of the detonator securing device of FIG. 1, taken through the displacement axis of the detonator latching slider.
Figure 3:
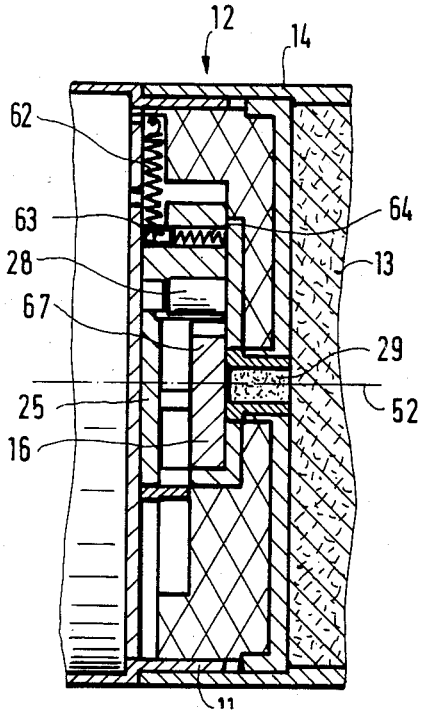
FIG. 3 illustrates a fragmentary longitudinal sectional view of the detonator securing device of FIG. 1 in parallel with the displacement axis of its impeller-generator carriage.

When the projectile 12 pertains to a subordinate ammunition article on which an ejecting acceleration 51 acts in a direction transversely of its longitudinal and subsequent flight axis 52 then, in correspondence therewith, the unlatching mechanism 50 is also oriented in this transverse direction. In the illustrated preferred embodiment, this consists of a so-called dual-recoil bolt system which responds to the ejecting acceleration 51 as the first surroundings-dependent unlatching criterium. The inertial mass of a responsive bolt 53, at a lateral ejection of the projectile 12 from its carrier (not shown), will effect a displacement relative to the detonator securing device 11, opposite the direction of acceleration 51 and the force of a spring 54, until the rearward end 55 of the bolt will free the lateral displacement capability of a locking ball 56. As a result, there is eliminated the blocking of the movement of the follower bolt 57, which will now displace in the same direction as the responsive bolt 53 due to its own inertial mass, and thereby compression load the compression spring 27 which is supported against a projection 58 on a detonator latching or securing slider 25. Due to this displacement, the follower bolt 57 concurrently releases the slider blocking element 31 which, in this instance, is preferably also formed as a locking ball 59. The follower bolt 57 is retained in this unlatching position through a spring-loaded latch 60 which engages therebehind, which concurrently functions as a support for the compression spring 27 opposite the projection.

At a certain time interval subsequent to the ejection of the projectile 12 from its carrier, the power element 43 of the control circuit 42 which is equipped with separate energy source for this purpose, is actuated in order to pull the locking pin 19 out of the carriage 16. This is then slid forwardly as the result of its prestressed compression spring 17 until the vaned wheel 22 of the impeller-generator 21 which has been designed for radial onflow conditions, after passing through the housing opening 23 will project beyond the periphery of the projectile wall 14. The surrounding air onflow against the projectile 12 which is in free flight after the ejection is the second environmental or surrounding unlatching criterium which is functionally independent of the first criterium. After some operating period, the necessary energy is delivered from the impeller-generator 21 for the actuation of the power element 44 to implement the pulling out of the locking pin 26 from the sliding guide 24 of the detonator 28. Inasmuch as the unlatching mechanism 50 which operates in dependence upon acceleration delivers the first unlatching criterium which is dependent upon the surroundings, will also stress the pressure spring 27, the latching slider 25 is thereby now slid rearward into its armed or "live" position (not shown in the drawing), in which the detonator 28 is aligned with the transmitting charge 29 in front of the combat charge 13 and a short-circuiting switch 30 (for the electrical short-circuiting of the detonator actuation in the secured position) is opened. The detonator 28, through the control circuit 42, is supplied with the detonating energy delivered by the impeller-generator 21, when ignition or fuse sensors (not shown in drawing) will respond due to target approach or target impact, or for instance, upon missing of a target there will respond an inertial sensor 61.

When, as the consequence of any kind of operational malfunction, the locking pin 26 for the detonator securing slide 24 should disengage prematurely; in essence, prior to the first surroundings-dependent unlatching criterium having taken place in the form of the operational sequence of the unlatching mechanism 50, and thereby prior to its compression spring 27 having been compressed, as well as its locking ball 59 having been able to deviate laterally from the angled front of its flange 37, will the detonator securing slider 25 be displaced forwardly by a tension spring 62; until a locking element 63, such as a pin standing under load by a compression spring 64, can engage as a latching between the securing slider 25 and an encompassing stationary component of the detonator securing device 11. Thereafter, the latching slider 25 can no longer be slid rearwardly, the detonator 28 is also no longer positioned in front of or adjacent the transmitting charge 29; in effect, the projectile 12 is thus securely latched from being a misfiring. Additionally, it can be suitable that in this misfiring-locked latching position of the latching slider 25, to allow a locking element 65 formed thereon to engage into the sliding guide 15 for the impeller-generator carriage 16, or directly into a latching opening 66 in the carriage 16; so that even at a releasing actuation of the power element 43, the impeller-generator 21 cannot travel outwardly into an operative position and thereby, in this position secured against misfiring, no electrical triggering energy can be delivered to the detonator 28.

As is illustrated, in this embodiment the direction of lateral outward displacement of the impeller-generator carriage 16 deviates from that of the detonator latching slider 25. This opens the possibility for other constructively simple and especially functionally reliable an alternative mechanical latching arrangement in that the latching slider 25 (as illustrated in the drawings) cannot be slid out of its secure position because any kind of reason into the armed or "live" position, as long as the impeller-generator carriage 16 has not yet been extended outwardly into its operative position. For this purpose, there is formed in the crossover region of the carriage 16 with the latching slider 25, an oppositely facing arrangement of recesses and projections 67, which will not come into engagement with each other only when the impeller-generator carriage 16 has been slid outwardly, and thereby because the lateral displacement, has freed the latching carriage 25 of the detonator into the detonator arming position. A complete transfer into this position of detonator preparedness in which the detonator 28 alone can be positioned so as to be armed, is thus clearly recognizable because of the vaned wheel 22 which has been slid outwardly of the projectile periphery. On the other hand, this position of detonator preparedness cannot be assumed prior to the installation of the detonator securing device 11 into a projectile 12, inasmuch as a projecting impeller-generator 21 would prevent the installation; and subsequent to the installation of the armed position can only be reached, as above indicated, after the response of the unlatching mechanism 50 to the first surroundings-dependent unlatching criterium, on the basis of a thereafter following definite further environmental criterium (air onflow against the outwardly extended generator 21).

What is claimed is:

1. Safe and arm unit for an ignition device for a projectile, including a detonator latching slider, an impeller-generator extendable laterally on a carriage outwardly of the projectile; a slider guidance for guiding said impeller-generator laterally of the longitudinal axis of the projectile, a securing means for the detonator latching slider being releasable by the electrical energy of the impeller-generator; a blocking element projecting into the slider guidance as long as the projectile remains in an unlaunched condition; a locking pin extending into the slider guidance for the carriage of the impeller-generator as long as the projectile is not yet launched; and a tension spring engaging the latching slider in opposition to the armed position of the forward displacement of said slider.

2. Safe and arm unit as claimed in claim 1, including recesses in the carriage and projections on the latching slider engaging into said recesses so as to allow for a displacement of the latching slider into the armed position of the detonator in only the outwardly extended position of said impeller-generator.

3. Safe and arm unit as claimed in claim 1, including an unlatching mechanism having means for effecting the release of said blocking element at the lateral acceleration of said projectile.

4. Safe and arm unit as claimed in claim 3, wherein the unlatching mechanism comprises a dual return action bolt system, a follower bolt of said system for releasing the blocking element, and a compression spring being stressed by said follower bolt for the forward displacement of said latching slider into an armed position.

5. Detonator securing device as claimed in claim 1, wherein a locking element on said latching slider engages into the carriage slider guide provided in the retracted position of said slider.

6. Detonator securing device as claimed in claim 5, wherein a latching opening on the carriage is engaged by said locking element.

7. Detonator security device as claimed in claim 5, wherein a further locking element is arranged on the latching slider engaging the latter in the retracted position thereof.

* * * * *